United States Patent [19]

Strom

[11] 4,091,309

[45] May 23, 1978

[54] PLASMA DISPLAY DRIVE CIRCUIT

[75] Inventor: Richard Albert Strom, Eagan, Minn.

[73] Assignee: Control Data Corporation, Minneapolis, Minn.

[21] Appl. No.: 794,881

[22] Filed: May 9, 1977

[51] Int. Cl.[2] ..... H05B 37/00; H05B 39/00; H05B 41/00

[52] U.S. Cl. ..... 315/169 TV; 340/324 M; 307/237

[58] Field of Search ..... 315/169 R, 169 TV; 340/324 M; 307/237

[56] References Cited

U.S. PATENT DOCUMENTS

| | | | |
|---|---|---|---|
| 3,790,849 | 2/1974 | Mayer et al. | 315/169 TV |
| 3,894,506 | 7/1975 | Mayer et al. | 315/169 TV |
| 3,969,718 | 7/1976 | Strom | 315/169 TV X |

*Primary Examiner*—Alfred E. Smith
*Assistant Examiner*—Robert E. Wise
*Attorney, Agent, or Firm*—William J. McGinnis, Jr.

[57] ABSTRACT

The present invention shows a plasma display panel drive circuit using low voltage controlled self-actuating devices as clamp circuits for selection of drive lines to be driven. Since such clamp circuits are in a normally ON condition for the sustain mode, the clamp circuits are self-actuating to transmit sustain pulses. The clamp circuits must be selected OFF to prevent the transmission of write and erase pulses in a self-actuating mode to the selected drive electrodes so that only the desired drive electrodes receive write and erase pulses.

4 Claims, 4 Drawing Figures

PLASMA DISPLAY DRIVE CIRCUIT

BACKGROUND OF THE INVENTION

This invention relates to drive circuitry and drive methods for plasma display panels of the alternating current type capacitively coupled to an ionizable gaseous medium. In particular, this invention relates to the clamp circuits which are used in selecting drive lines to be driven in various operations of a plasma display panel. In particular, self-actuating clamps are shown for both polarities of applied voltage which are self-actuating during the normally ON sustain drive mode of the plasma display panel. There is substantial prior art relating solely to drive circuits for plasma display panels. All of these patents represent efforts at improving the cost and efficiency factors of plasma display circuit design. Improvement has been through use of low voltage rather than high voltage switching devices as well as use of drive techniques which requires a minimum number of electronic devices for the overall drive system.

SUMMARY OF THE INVENTION

The present invention shows a matrix arrangement of drive circuitry having different clamp circuits for the X and Y drive axes of a plasma display panel. This circuitry is implemented using low voltage controlled switching elements for the selection and application of operational pulses to the drive elements of a plasma display panel of any of several well-known types. The low voltage controlled switching elements operate in such a manner that the devices change state from an ON condition to an OFF condition at times in the drive cycle before and after the sustain pulses are to be applied.

One present feature of state-of-the-art drive circuits is their requirement for floating power supplies for certain drive functions of a plasma display panel and the use of transformers on individual drive lines in order to achieve switching operations or superimposed voltages. The present invention has the advantage of being "ground-referenced" in that switching operations occur at low voltages with respect to the system ground reference level. This eliminates the need for floating power supplies or transformers in the drive circuits.

As will be described in detail, the X axis clamps, according to the present invention, all turn on automatically when the sustain output driver voltage is falling. Each X axis clamp is comprised of a transistor switch and blocking diode in series across the terminals of the clamp device such that a changing voltage across the terminals in the appropriate direction will cause a normally ON state. This result is obtained by proper biasing of the transistor according to the circuit of the invention. The same biasing circuit is also designed through the use of reference voltages so that a low voltage switch can be used to bias the output transistors in an OFF condition for selection.

In the circuit according to the present invention, the Y axis clamp circuits all turn ON automatically when the sustain output is rising. The Y axis clamp circuits according to the present invention are comprised of transistors across the clamp terminals and include an appropriate bias circuit for the transistor to cause it to be in a normally ON state when the sustain voltage across it is rising. Similarly, as with the X axis clamp circuits, the bias network for the Y axis clamp circuits is so designed that a low voltage control signal operates the switching transistor in the select mode.

IN THE FIGURES

FIG. 1 shows an overall system schematic diagram for a drive circuit according to the present invention.

DESCRIPTION OF THE PREFERRED EMBODIMENT

Figure 2:
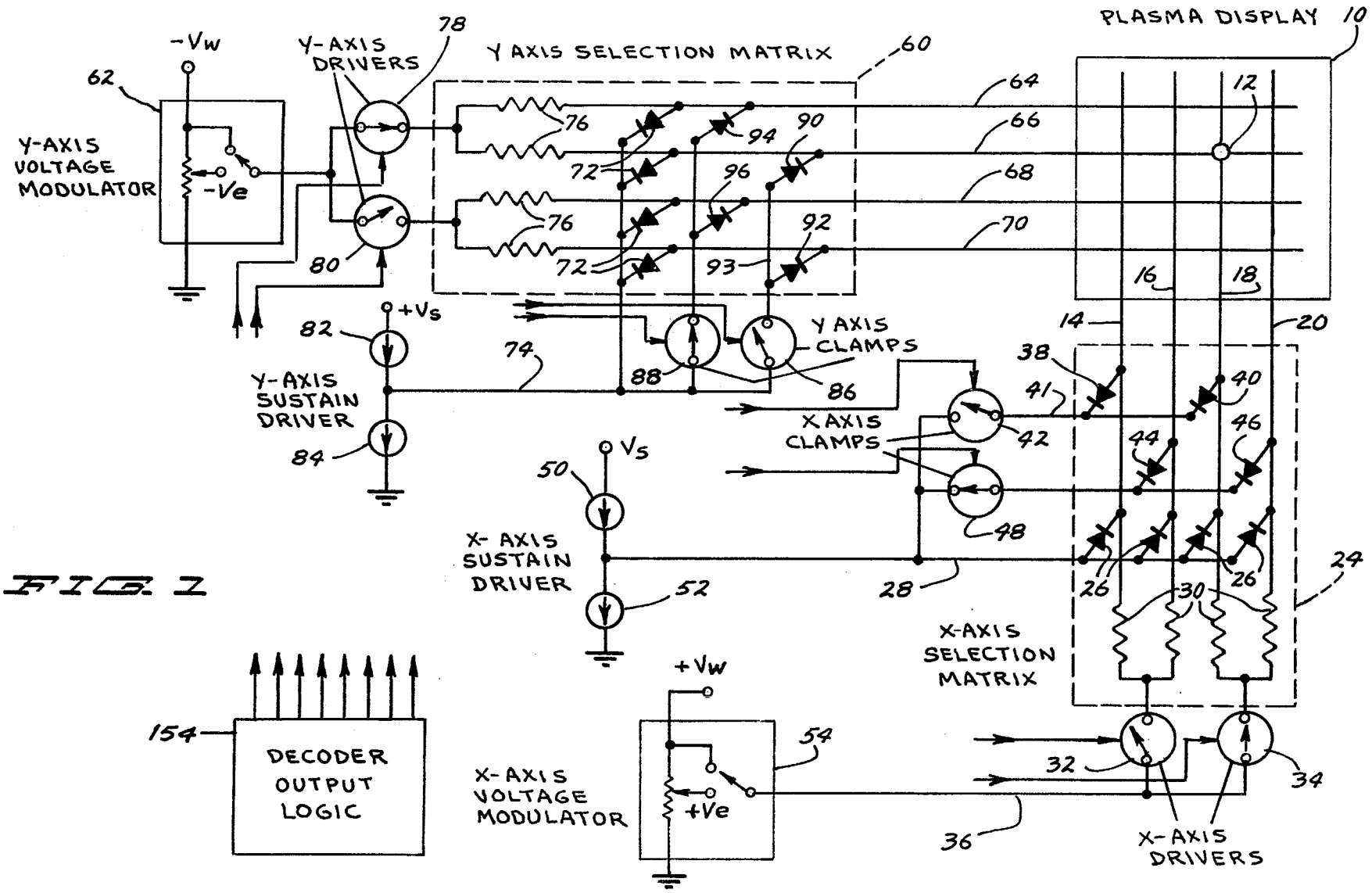
FIG. 2 is a detailed circuit diagram of a single Y axis clamp circuit.
Figure 2:
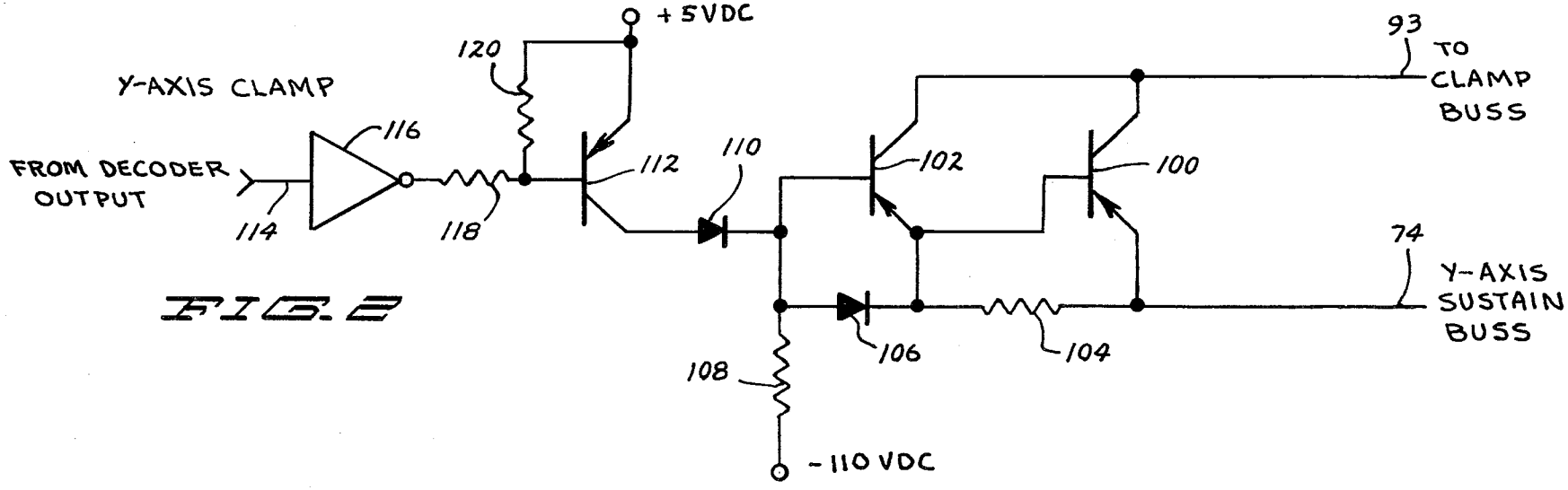

Referring now to FIG. 1, a plasma display panel 10 is shown which may be of the conventional alternating current driven type having orthogonal arrays of drive electrodes arranged with respect to an ionizable gaseous medium and capacitively coupled thereto to define display cells or display elements at the intersections of the drive electrodes. Such panels may be of the type having one array of drive electrodes on one side of the gaseous medium and the other array of electrodes on the other side of the gaseous medium or of the type in which all drive electrodes are imbedded within a single surface with the gaseous medium disposed against the surface. The patent literature describes numerous such panels in detail. Of course, other subspecies of such panels or other types of panels having orthogonal drive elements may exist or may be invented which may use the present invention. The present display panel is shown in a four-element by four-element array for illustrative purposes, but conventional design of matrix selection circuits will allow expansion to any desired size using the scheme shown herein. For purposes of illustration, a selected display element 12 is identified within the panel.

The group of X axis drive electrodes is identified as 14, 16, 18 and 20, all connected from the plasma display panel 10 to the X axis selection matrix 24 which may be of conventional design. Within the X axis selection matrix 24 is a group of sustain drive diodes 26, all connected from the X axis sustain buss 28 to respective drive electrodes 14, 16, 18 and 20. Also connected to the drive electrodes are isolation resistors 30 which are connected to X axis drivers 32 and 34. X axis drivers 32 and 34 may be of conventional design but are connected to the X axis voltage modulator buss 36, the function of which is to be explained. Also connected to the drive electrodes are clamp diodes 38 and 40 connected to X clamp 42 and diodes 44 and 46 connected in turn to X clamp 48. Diodes 38 and 40 are connected to X axis clamp buss 41. The other terminals of the X axis clamps are connected to the X axis sustain driver buss 28. X axis drivers 32 and 34 are shown as ON-OFF switches, which is schematically accurate of their function. X axis clamps 42 and 48 are shown as ON-OFF switches which is schematically accurate of their function, although the circuit to accomplish this function will be described in detail.

The X axis sustain driver is comprised of switches 50 and 52, which operate in a conventional manner to provide the sustain drive buss 28 with either a connection to ground or to a source of sustain voltage. The X axis voltage modulator 54 is connected to a source of voltage and is comprised of conventional circuitry which may switch between the source voltage supplied or a lower voltage from a voltage divider as shown schematically.

The Y axis selection matrix 60 is of conventional design and is similar in design to the X axis selection matrix 24, but is designed for functioning with a negative source voltage for the Y axis voltage modulator 62, whereas, the X axis selection matrix is designed for functioning with a positive source voltage for the X axis voltage modulator 54. The Y axis selection matrix 60 is connected with drive electrodes 64, 66, 68 and 70. The intersection of drive electrode 66 from the Y axis and drive electrode 18 from the X axis defines display element 12.

Within the Y axis selection matrix are a plurality of diodes 72 connected from the Y axis sustain drive buss 74 to the respective drive electrodes 64, 66, 68 and 70. Further, there are isolation resistors 76 connected from the drive electrodes 64 and 66 to a Y axis driver 78 and from drive electrodes 68 and 70 to a Y axis driver 80. The Y axis drivers 78 and 80 are connected to the Y axis voltage modulator shown schematically to provide a direct source of the negative reference Voltage or a slightly reduced negative voltage. The Y axis sustain driver is comprised of switches 82 and 84 which provide a source of sustain voltage or a connection to ground for the Y axis sustain drive buss 74.

The voltage modulators, 54 and 62, are similar in function in that they provide the source of write voltage or erase voltage required for the drive system of the plasma display panel according to the present invention. The full voltage that has not been reduced on each axis is the write voltage which is approximately 110 volts positive supplied to X axis voltage modulator 54 and approximately −110 volts as supplied to Y axis voltage modulator 62. The reduced voltage in each case represents the erase voltage which according to the present example may be +55 volts for the X axis and −55 volts for the Y axis. Symbolically, these are indicated in FIG. 1 as $+Vw$, $+Ve$, $-Vw$ and $-Ve$. Similarly, the sustain voltage is indicated schematically in FIG. 1 as $Vs$, and according to the present example, may be approximately 110 volts.

Referring now to FIG. 2, a single Y axis clamp is shown according to the present invention. Thus, the clamp shown may be taken to be either clamp 86 or 88 as shown in FIG. 1. The clamp has two output terminals, one of which is connected to the Y axis sustain driver buss 74 and the other of which is connected to either the pair of diodes 90 and 92 as one clamp buss or diodes 94 and 96 on the other clamp buss. For purposes of convenience of explanation, the clamp buss connected between Y axis clamp 86 and diodes 90 and 92 is labeled as clamp buss 93 and therefore, the Y axis clamp shown in FIG. 2 would represent the Y axis clamp 86 shown in FIG. 1.

The Y axis clamp is comprised of a first transistor 100 with its emitter connected to the sustain buss 74 and its collector connected to the clamp buss 93. Connected to the base of output transistor 100 is the emitter of transistor 102 which is also connected through a resistor 104 to the emitter of transistor 100. The collectors of transistors 100 and 102 are connected together. Transistor 102 serves to form a bias network and amplifier for output transistor 100. A bypass diode 106 is connected between the base and the emitter of transistor 102 to allow the bias circuit to turn off transistor 100 when selected OFF. A resistor 108 provides a negative source of bias voltage to the emitter of transistor 102. A diode 110 provides a switching signal to the emitter of transistor 102. Diode 110 is connected to the collector of transistor 112 which has its emitter connected to a positive voltage source. Transistor 112 receives its input first from a logic decoder output control 114 which is amplified and inverted by conventional amplifier 116. Resistors 118 and 120 form a bias network for transistor 112. Transistor 112 is normally OFF during sustain voltage cycling and is turned ON by the decoder logic unit in order to maintain the clamp output in the OFF condition during selection when the sustain buss is at a near zero (ground) potential. The Y axis clamp is in a normally ON condition when the sustain driver output is rising. Transistors 100 and 102, controlled with the appropriate bias network as described thus, are in a normally ON conducting condition when the voltage on the Y axis sustain buss 74 is higher than the voltage on the clamp buss 93.

Figure 3:
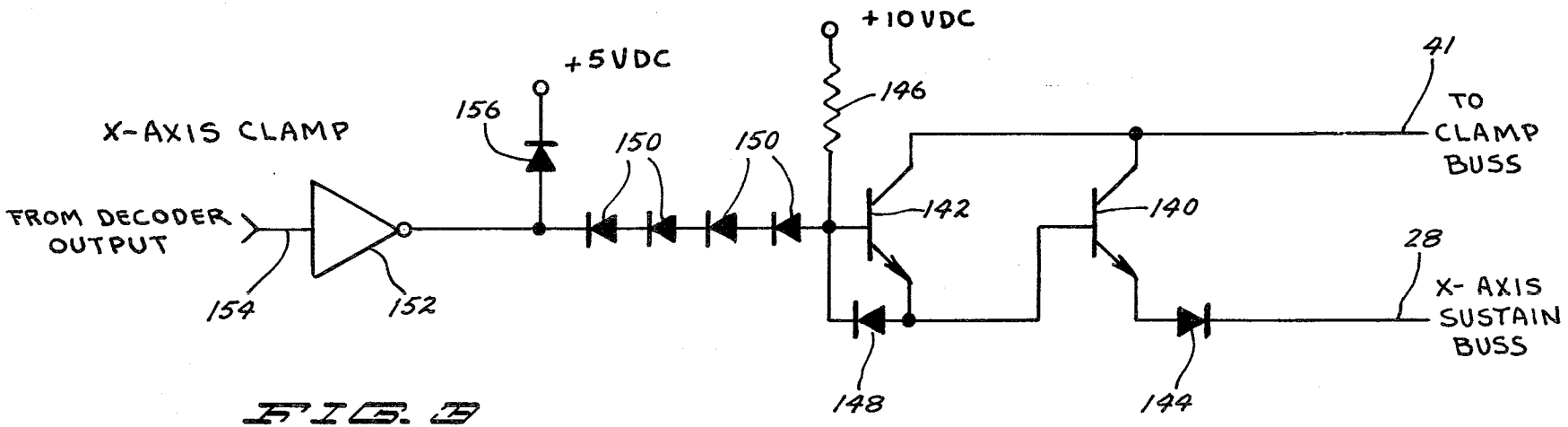
FIG. 3 is a detailed circuit diagram of a single X axis clamp circuit.

Referring now to FIG. 3, an X axis clamp is shown which has a similar function to that of the Y axis clamp previously described. However, since the X axis clamp is to be normally ON when the sustain output voltage is falling, the circuit must be of slightly different design in order to be normally ON at the desired time. The X axis clamp shown in FIG. 3 may be either clamp 42 or 48 as shown in FIG. 1, but for convenience, is shown as clamp 42 connected between sustain buss 28 and clamp buss 41 connected to diodes 38 and 40. An X axis clamp is comprised of a transistor 140 having its emitter connected to the X axis sustain drive buss 28 and its collector connected to the X axis clamp buss 41. A bias network for this transistor is formed by transistor 142 having its emitter connected to the emitter of transistor 140. A blocking diode 144 is placed in the emitter connection of transistor 140 for voltage breakdown protection when the sustain voltage is rising. The collector of transistor 142 is connected with the collector of transistor 140. The emitter of transistor 142 is connected through a resistor 146 to a source of positive bias voltage and through a diode 148 to the emitter of transistor 142. A string of diodes 150 provides the proper bias voltage at the base of transistor 142 when amplifier 152 has a low output state. This bias voltage will keep transistor 142 and 140 off allowing the selected panel electrodes to receive the positive write or erase pulse. Amplifier 152 is connected to the decoder output logic 154 shown schematically. A diode 156 clamps the output of amplifier 152 to a source of positive reference voltage. When the output of amplifier 152 is low, and the sustain voltage is low, the clamp circuit is forced to the OFF or unclamped condition. When the output from amplifier 152 is high, the clamp circuit turns on and inhibits the write or erase pulse from the driver. The clamp circuit turns on automatically during the time a sustain pulse is applied. It turns on when the sustain voltage is falling and the emitter of transistor 140 is pulled more negative than its base.

Figure 4:
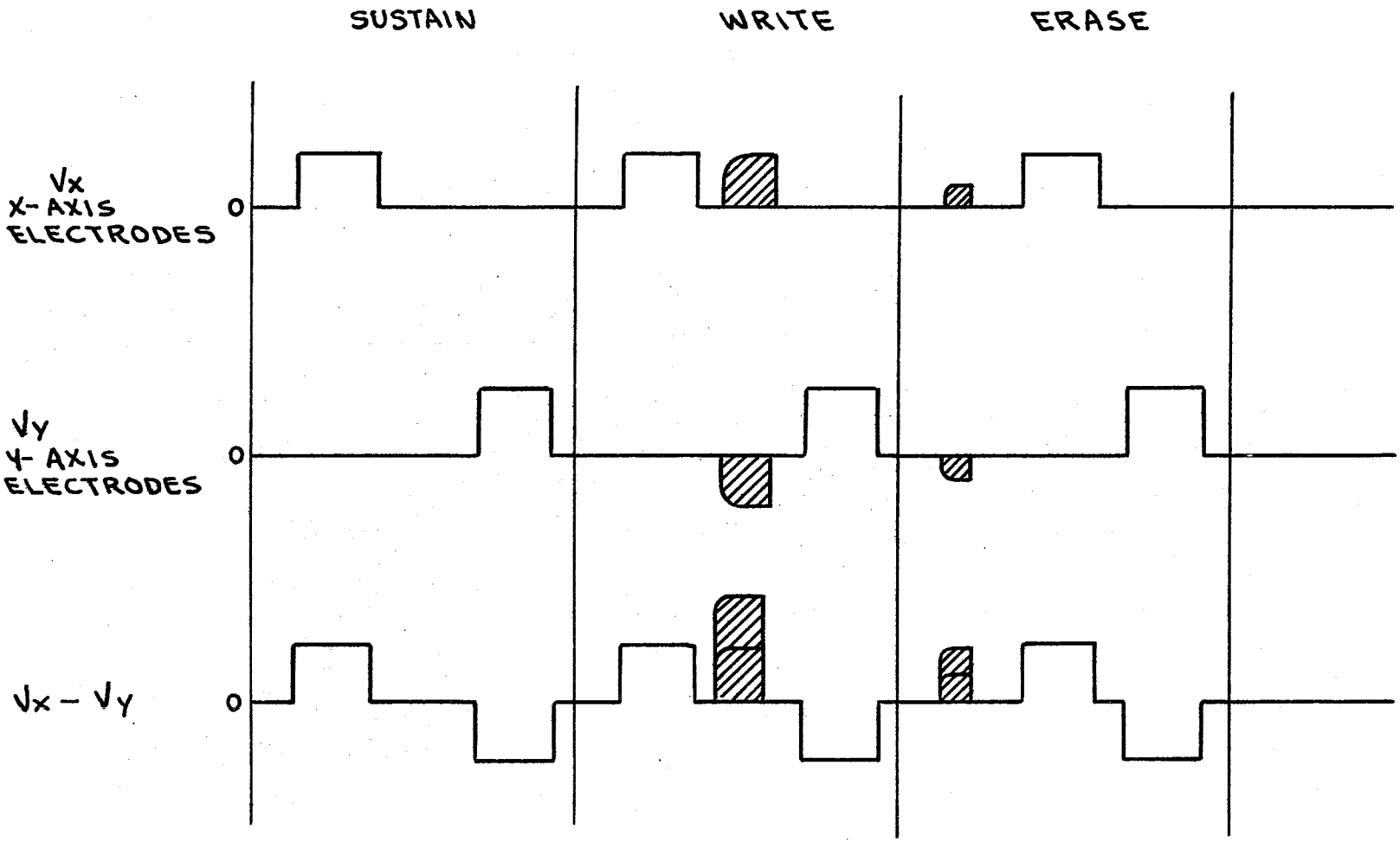
FIG. 4 is a diagram showing drive pulses as applied to the plasma display panel using the drive circuit according to the present invention in one method of operation.

Referring now to FIG. 4, a series of pulse trains are shown relating to the operation of the circuit according to the present invention in an operating plasma display panel. The top pulse train shows the voltage as applied to the X axis electrodes, the second wave train shows the voltage applied to the Y axis electrodes, and the bottom wave train shows the voltages as applied to a given display element in the display panel, such as element 12. The first or left most section shows the conventional sustain pulse train as applied to the panel. The second or middle section shows the conventional write pulses applied immediately after a sustain pulse on the X axis electrode and before the corresponding sustain pulse on the Y axis electrode and the summed signal created at the display element. Similarly, the last segment of the wave train display shows the smaller positive half-select erase pulse voltage applied just before a conventional sustain pulse on the X axis electrodes simultaneously with the application of the negative half-select erase pulse on the Y axis electrodes and the resultant full amplitude erase pulse occuring just prior to a similar polarity sustain pulse at the display element.

During sustaining, the write/erase driver switches 32, 34, 78 and 80 are open and the clamp switches 42, 48, 86 and 88 are closed. Sustain pulses are coupled to the panel through the closed clamp switches or through diodes. During writing or erasing, the outputs of the sustain drivers are grounded or are at a near zero voltage by closing switches 52 and 54.

The example in FIG. 1 shows the switch positions for selection of the display element 12. The write/erase driver switches 34 and 78 are closed, and the clamp switches 42 and 86 are open. This condition allows one-half of the selection voltage Vw or Ve to be applied to electrode 18 and the other half $-Vw$ or $-Ve$ to be applied to electrode 66. The result is a full selection voltage 2 $Vw$ or 2 $Ve$ applied to element 12 for either the write function or the erase function. All of the other elements on the panel have either a half selection voltage or zero voltage. Decoder output logic 154 controls the various functions as described by providing control signals for the X and Y drivers and clamps 32, 34, 42, 48, 78, 80, 86 and 88. The sustain drivers are driven in conventional fashion. The voltage modulators 54 and 62 are switched between high and low voltage depending upon whether writing or erasing is the function to be performed. Logic unit 154 receives its input in any conventional fashion, as for example, digital signals from a computer system, for controlling the display.

What is claimed is:

1. In apparatus for driving a plasma display panel of a type having a plurality of drive electrodes comprising a first group and a second group of drive electrodes in generally orthogonal relationship to said first group in matrix arrangement and in which orthogonal pairs of said drive electrodes uniquely specify all display elements in the panel, and wherein said apparatus includes first drive means for selectively providing voltages in matrix interconnection to said first group of drive lines and second drive means for selectively providing voltages in matrix interconnection to said second group of drive lines, wherein the improvement comprises:

a first voltage modulator means connected with said first drive means for selectively switching a supply voltage to said first drive means between an erase voltage potential and a write voltage potential, a second voltage modulator means connected with said second drive means for selectively switching a supply voltage to said second drive means between an erase voltage potential and a write voltage potential, a first sustain drive means for selectively switching between a sustain drive potential and a ground potential said sustain drive means connected with said first drive means, a second sustain drive means for selectively switching between a sustain drive potential and a ground potential, said sustain drive means connected with said second drive means, a plurality of a first clamp bus selection means connected to said first sustain drive means and connected in matrix arrangement to said first groups of drive electrodes, each of said clamp bus selection means being automatically actuated to switch on by the application of the sustain drive voltage potential from the first sustain drive means and each of said clamp bus means being selectively actuable by a control signal to allow associated drive electrodes of said first group to float to a potential as said first drive means applies a voltage potential to provide selected electrodes of said first group, and a plurality of a second clamp bus selection means connected to said second sustain drive means and connected in matrix arrangement to said second group of drive electrodes, each of said clamp bus selection means being automatically actuated to switch on by the application of the sustain drive voltage potential from the second sustain drive means and each of said clamp bus means being selectively actuable by a control signal to allow associated drive electrodes of said second group to float to a potential as said second drive means applies a voltage potential to provide selected electrodes of said second group.

2. The apparatus of claim 1 herein each of said clamp bus selection means is comprised of:

a first transistor having its emitter and collector connected between a matrix arrangement of drive electrodes and a sustain drive means to act as an on and off switch, a second transistor having its emitter connected with the base of the first transistor and at least one other connecting means between said transistors, and second transistor acting to bias said first transistor, and bias means for said second transistor.

3. The apparatus of claim 2 and further comprising, means for receiving and amplifying a control signal and means for connecting the output of said means for amplifying with said first transistor to bias said first transistor to an off condition upon receipt of a control signal.

4. In apparatus for driving a plasma display panel of a type having a plurality of drive electrodes comprising a first group and a second group of drive electrodes in generally orthogonal relationship to said first group in matrix arrangement and in which orthogonal pairs of said drive electrodes uniquely specify all display elements in the panel, and wherein said apparatus is of the matrix selection type having at least two sustain drive means associated with each group of drive electrodes and at least two clamp bus selection means associated with each group of drive electrodes, each clamp bus selection means being connected to at least two diodes, each diode being connected to a single drive electrode, the improvement comprising a clamp bus selection means including:

a first transistor acting as a switch between a clamp bus and one of said sustain drive means, a bias network associated with said transistor having the characteristic that said transistor is automatically biased to an on condition by said network when a sustain voltage potential is applied to said transistor in its forward direction, and control circuit means connected with said bias network to bias said transistor to an off condition to allow said clamp bus potential to float during application of a write or erase pulse.

* * * * *